US010851478B2

(12) United States Patent
D'Agnolo et al.

(10) Patent No.: US 10,851,478 B2
(45) Date of Patent: Dec. 1, 2020

(54) AIR-JET TYPE SPINNING DEVICE

(71) Applicant: SAVIO MACCHINE TESSILI S.p.A., Pordenone (IT)

(72) Inventors: Fabio D'Agnolo, Pordenone (IT); Vittorio Colussi, Pordenone (IT)

(73) Assignee: SAVIO MACCHINE TESSILI S.P.A. (IT)

( * ) Notice: Subject to any disclaimer, the term of this patent is extended or adjusted under 35 U.S.C. 154(b) by 228 days.

(21) Appl. No.: 15/582,121

(22) Filed: Apr. 28, 2017

(65) Prior Publication Data

US 2017/0314167 A1 Nov. 2, 2017

(30) Foreign Application Priority Data

Apr. 29, 2016 (IT) ..... 102016000043984

(51) Int. Cl.
*D01H 4/02* (2006.01)
*D01H 1/115* (2006.01)

(52) U.S. Cl.
CPC ..... *D01H 4/02* (2013.01); *D01H 1/115* (2013.01)

(58) Field of Classification Search
CPC ..... D01H 4/02; D01H 1/115; D01H 4/38
USPC ..... 57/350
See application file for complete search history.

(56) References Cited

U.S. PATENT DOCUMENTS 2,884,756 A * 5/1959 Head ..... D02G 1/16 28/271
3,655,862 A * 4/1972 Dorschner et al. .... B65H 51/16 226/7
5,295,349 A * 3/1994 Okamoto ..... D01H 4/02 57/328

(Continued)

FOREIGN PATENT DOCUMENTS

DE 16 85 925 8/1971
DE 10255035 A1 * 6/2004 ..... D01H 1/115

(Continued)

OTHER PUBLICATIONS

English translation of WO2004067820 to Stahlecker, obtained via espacenet.com on May 30, 2019.*

(Continued)

*Primary Examiner* — Shaun R Hurley
*Assistant Examiner* — Patrick J. Lynch
(74) *Attorney, Agent, or Firm* — Valauskas Corder LLC

(57) ABSTRACT

An air-jet type spinning device (4), comprising a body (8) at least partially hollow which defines a spinning chamber (12), a fibre feeding device (16) that feeds fibres into the spinning chamber (12), and a spinning spindle (20) including a spinning channel (24) for the suction of yarn obtained from the fibres. The device (4) including at least one channel (28) for sending a jet of compressed air inside the spinning chamber (12). A flow amplifier (32) comprising an expansion chamber (36) is in fluidic connection with the outside of the body (8), wherein the at least one channel (28) comes out in an emission point (40) inside the expansion chamber (Continued)

(36), to introduce compressed air at an inlet cross-section (44). The expansion chamber (36) comprises an outlet mouth (48), fluidically connected to the spinning chamber (12) and having an outlet cross-section (52) smaller than the inlet cross-section (44).

18 Claims, 8 Drawing Sheets

(56) References Cited

U.S. PATENT DOCUMENTS

| | | | | |
|---|---|---|---|---|
| 5,326,009 | A * | 7/1994 | Kobayashi | D04H 3/03 226/97.4 |
| 2004/0025488 | A1* | 2/2004 | Anderegg | D01H 1/115 57/400 |
| 2006/0096271 | A1* | 5/2006 | Yamamoto | D01H 1/115 57/350 |
| 2008/0190089 | A1* | 8/2008 | Stahlecker | D01H 1/115 57/350 |
| 2008/0276594 | A1* | 11/2008 | Stahlecker | D01H 1/115 57/403 |
| 2014/0116022 | A1* | 5/2014 | Kubler | D01H 4/02 57/350 |
| 2014/0237985 | A1 | 8/2014 | Schaffler | |

FOREIGN PATENT DOCUMENTS

| | | | | |
|---|---|---|---|---|
| EP | 0 368 108 | | 5/1990 | |
| EP | 2 677 070 | | 12/2013 | |
| WO | WO-2004059052 | A1 * | 7/2004 | D01H 1/115 |
| WO | WO-2004067820 | A1 * | 8/2004 | D01H 1/115 |

OTHER PUBLICATIONS

English translation of WO2004059052 to Schweier, obtained via espacenet.com on May 30, 2019.*

English translation of DE10255035 to Stahlecker, obtained via espacenet.com on May 30, 2019.*

Italian Search Report, dated Sep. 21, 2016.

* cited by examiner

AIR-JET TYPE SPINNING DEVICE

CROSS-REFERENCE TO RELATED APPLICATIONS

The present invention claims priority to Italian Patent Application No. 102016000043984 filed on Apr. 29, 2016.

FIELD OF APPLICATION

The present invention relates to an air-jet type spinning device.

STATE OF THE ART

As is known, air-jet type spinning devices perform yarn production starting from a fibre sliver.

Said sliver is subjected to the action of jets of compressed air (air-jet) which enable the outermost fibres to open up and wrap themselves around the central fibres, forming the yarn.

The solutions of the prior art have a number of drawbacks and limitations.

In fact, first of all a considerable consumption of compressed air is required in order to first open the outer fibres of the sliver and then wrap them around the central ones to form the yarn.

Obviously a high consumption of compressed air increases energy consumption and therefore leads to higher production costs of the yarn.

In addition, the prior solutions, in order to obtain good quality yarns require the creation of small spinning chambers. This way however, the chambers are extremely sensitive to the presence of dirt and fibrils which compromise the quality, repeatability and strength of the yarn.

As a result, the prior solutions are very sensitive to the degree of cleanliness of the spinning chamber and require frequent maintenance and cleaning thereof, if a high quality yarn of good strength is to be obtained.

In addition, the prior solutions entail some structural constraints in the realization of the spinning chamber since the jets of compressed air must be directed in an extremely accurate manner in proximity of the tip of the spinning spindle: in other words the jets must be directed in a tangential direction and tilted downwards to obtain the necessary compressed air whirling motion which must, on the one hand, interweave the fibres and on the other create the necessary vacuum for the suction of the fibres inside the spinning spindle. Despite such geometric constraints the prior solutions do not always guarantee control of the direction of the jets of compressed air inside the spinning chamber since the air, once it has left the nozzles, is not guided in its feed movement but propagates freely inside the spinning chamber. For this reason the air is more prone to deviations both due to the presence of impurities, such as fibrils and dirt, and to the presence of turbulence and vorticity.

This variability in the operating conditions of the spinning, as seen, contributes to poor repeatability of the yarn quality produced.

In conclusion, the air-jet devices of the prior art entail a significant consumption of compressed air, high production costs and do not always guarantee the constancy and repeatability of obtaining a high quality, strong yarn.

PRESENTATION OF THE INVENTION

The need is therefore felt to resolve the drawbacks and limitations mentioned with reference to the prior art.

Such need is satisfied by an air-jet spinning device according to claim 1.

DESCRIPTION OF THE DRAWINGS

Further characteristics and advantages of the present invention will be more clearly comprehensible from the description given below of its preferred and non-limiting embodiments, wherein.

The elements or parts of elements common to the embodiments described below will be indicated using the same reference numerals.

DETAILED DESCRIPTION

Figure 1:
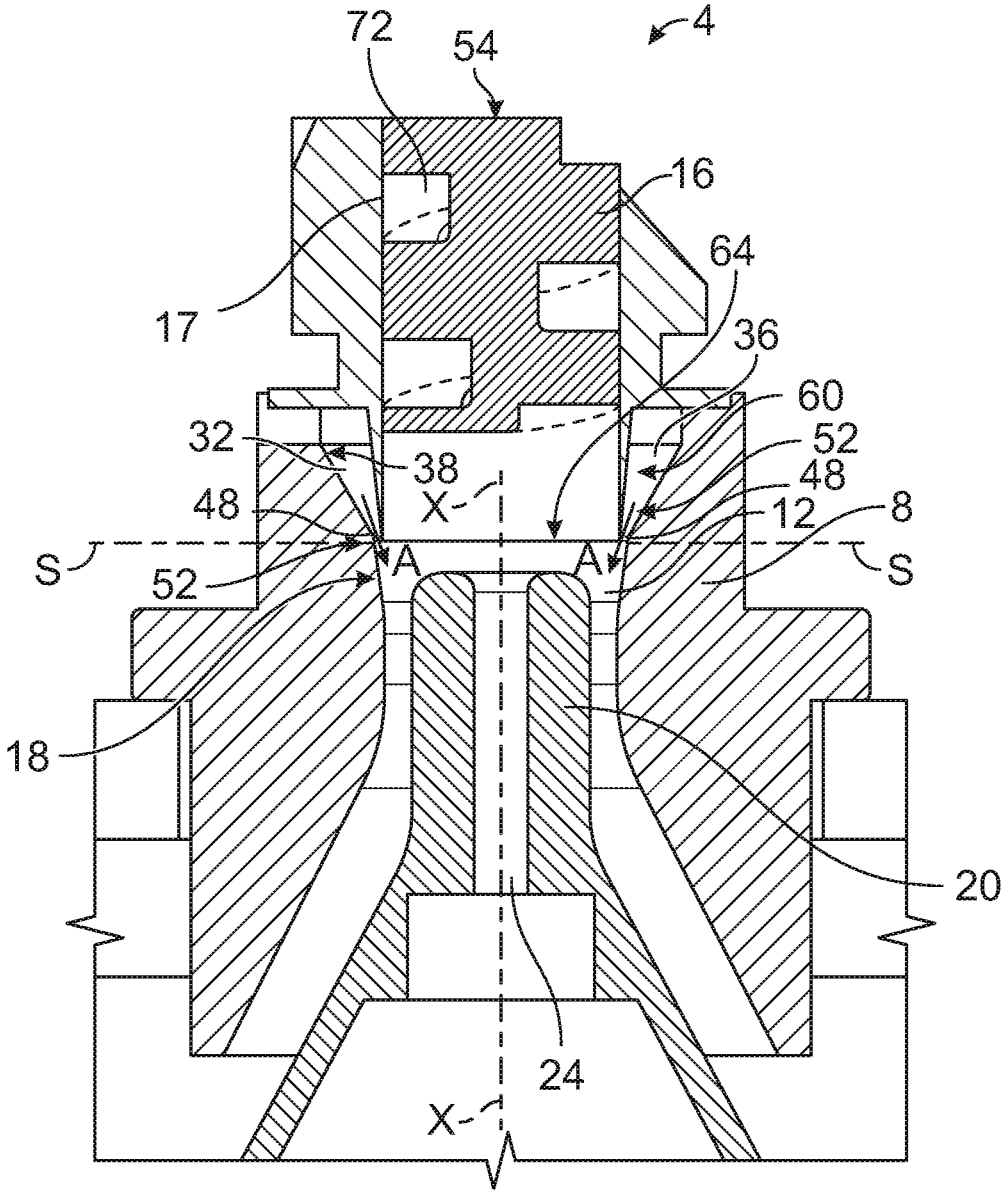
FIGS. 1-2 shows cross-section views of an air-jet type spinning device according to a further embodiment of the present invention.

With reference to the aforementioned figures, reference numeral 4 globally denotes an air-jet type spinning device comprising an at least partially hollow body 8 which delimits a spinning chamber 12, and a fibre feeding device 16, facing said spinning chamber 12 so as to feed the fibre to the spinning chamber 12. The spinning chamber 12 is defined by an outer side wall 18.

The spinning device 4 further comprises a spinning spindle 20 at least partially inserted in the spinning chamber 12 and fitted with a spinning channel 24 for the suction of yarn obtained from said fibres. The spinning channel 24 defines a spinning direction X-X.

The spinning device 4 further comprises at least one channel 28 for sending a jet of compressed air inside an expansion chamber 36, described further below.

Advantageously, the body 8 comprises a flow amplifier 32 comprising an expansion chamber 36 in fluidic connection with the outside of the body 8. The expansion chamber 36 is defined by a first outer wall 38.

The at least one channel 28 comes out in an emission point 40 inside the expansion chamber 36, to introduce compressed at an inlet cross-section 44, measured in relation to a cross-section plane S-S perpendicular to said spinning direction X-X, The expansion chamber 36 further comprises an outlet mouth 48, fluidically and directly connected to the spinning chamber 12 and having an outlet cross-section 52 smaller than said inlet cross-section 44, said outlet cross-section 52 being measured relative to a cross-section plane S-S perpendicular to said spinning direction X-X. The outlet cross-section 52 has a thickness varying between 0.03 mm and 0.30 mm, depending on the material being processed.

Advantageously, said outlet mouth 48 is shaped so as to present a profile shaped to create an outlet path of the air which is parallel to said profile, i.e. which adheres to the profile by means of the Coandă effect.

This way, the desired effect is achieved, i.e. the fibres can be twisted and forced downwards so that they can wrap themselves on the central fibres of the yarn being formed.

The size and shape of the outlet mouth 48 generates a considerable speed increase of the outgoing air: said accelerated air flow adheres, by means of the Coandă effect, to the outer side wall 18 of the spinning chamber 12, adjacent to the outlet mouth 48 of the expansion chamber 36.

The high speed air in output creates a vacuum effect which draws air in from the fibre feeding device 16, for example from the fibre feed side.

The fibre feeding device 16 is in actual fact connected with the outside, i.e. with the atmosphere, through a suction mouth 54. The suction mouth 54 is fluidically connected to the spinning chamber 12 by means of an air supply channel 72.

The air flow accelerates at the outlet from the chamber 36 on account of the specific geometry thereof, determining the effect of drawing in from outside, through the suction mouth 54, a quantity of air up to 2-3 times greater than that leaving the chamber 36 through the outlet mouth 48.

In the figures, the flow of air under pressure, injected from the at least one channel 28 is shown with the arrows P.

The intake air flow, i.e. the flow amplification due to the vacuum created by the compressed air flowing in the spinning chamber 12 through the outlet mouth 48, is instead shown by the arrows A. This additional air is sucked in from the atmosphere through the suction mouth 54.

Summing up the functioning of the flow amplifier, the compressed air is introduced into the expansion chamber 36 and fills it until it is discharged through the outlet mouth 48, having an appropriately shaped outlet cross-section 52 so that the air can accelerate, adhering to the profile by means of the Coandă effect.

The air in output falls in pressure as a result of the smaller cross-section considerably increasing its speed. The flow of air at high speed, thanks to the Coandă effect adheres to the appropriately designed profile, drawing in air from outside.

The end result is that the flow of air at high speed is discharged into the spinning chamber 12.

This high-speed flow generates a vacuum which draws in a large flow of air drawn in from outside the expansion chamber 36, through said suction mouth 54.

The expansion chamber 36, compared to a cross-section plane S-S perpendicular to the spinning direction X-X, has a circular crown cross-section.

For example, said circular crown cross-section decreases as it moves, parallel to the spinning direction X-X, towards the outlet mouth 48.

Preferably, said circular crown cross-section is minimal at the outlet mouth 48.

The fibre feeding device 16 is housed at least partially in the expansion chamber 36, so that said circular crown cross-section of the expansion chamber 36 is delimited between the first outer wall 38 of the expansion chamber 36, and a second outer wall 60 of the fibre feeding device 16.

Preferably, the fibre feeding device 16 is inserted inside the expansion chamber 36 up to the height of said outlet mouth 48.

Preferably, the expansion chamber 36 has a variable cross-section, measured with respect to a cross-section plane S-S perpendicular to the spinning direction X-X, wherein said cross-section decreases as it moves, parallel to the spinning direction X-X, towards the spinning spindle 20.

According to a possible embodiment, said at least one channel 28 is oriented to direct the jet of compressed air inside the expansion chamber 36 according to a horizontal direction lying on a plane perpendicular to the spinning direction X-X.

According to one embodiment, the at least one channel 28 is oriented in a direction tangential T-T, in the respective emission point 40, to the first outer wall 38 of the expansion chamber 36.

According to one embodiment, the spinning device 4 comprises at least two channels 28', 28", each sending a respective jet of compressed air to the expansion chamber 36.

For example, said at least two channels 28', 28" are placed in positions diametrically opposite to each other with respect to an axis of symmetry parallel to the spinning direction X-X.

Moreover, said at least two channels 28', 28" which send compressed air to the expansion chamber 36 may be staggered with each other with respect to the spinning direction X-X.

According to one embodiment, at least one channel 28 is tilted at a sharp angle with respect to a horizontal plane, perpendicular to said spinning direction X-X, in a direction moving towards the spinning spindle 20 so as to create a downward acceleration of the fluid.

Preferably, the channels 28, 28', 28" are positioned so as to send the relative jets of compressed air to respective emission points 40 located upstream of a feed hole 64 of the fibres to the spinning chamber 12, relative to the spinning direction X-X.

It is to be pointed out that to enable the outermost fibres to open up and wrap around the central fibres to form the yarn, a rotary or better still spiral motion must be imparted to the flow of air flowing inside the spinning chamber 24 given by the composition of rotational motion and translational motion parallel to the spinning direction X-X.

There are various ways of achieving the rotation effect of the air flow inside the spinning chamber 12, needed to wrap the fibres.

For example, as seen, it is possible to direct the flows of compressed air in a tangential direction T-T (FIG. 2) to generate a spiral movement of the compressed air inside the expansion chamber 36. Such spiral motion comprises a tangential speed component, given by the orientation of the channel 28, and an axial component parallel to the direction of spinning X-X, towards the outlet mouth 48.

This way the flow of air flows into the expansion chamber 36 with a spiral motion and engenders or imparts the same spiral motion to the flow of air sucked in by the suction mouth 54. The latter, which constitutes the bulk of the air flow in the spinning chamber 12, performs the opening and twisting of the fibres around the central fibres, thereby obtaining the yarn.

Figure 2:
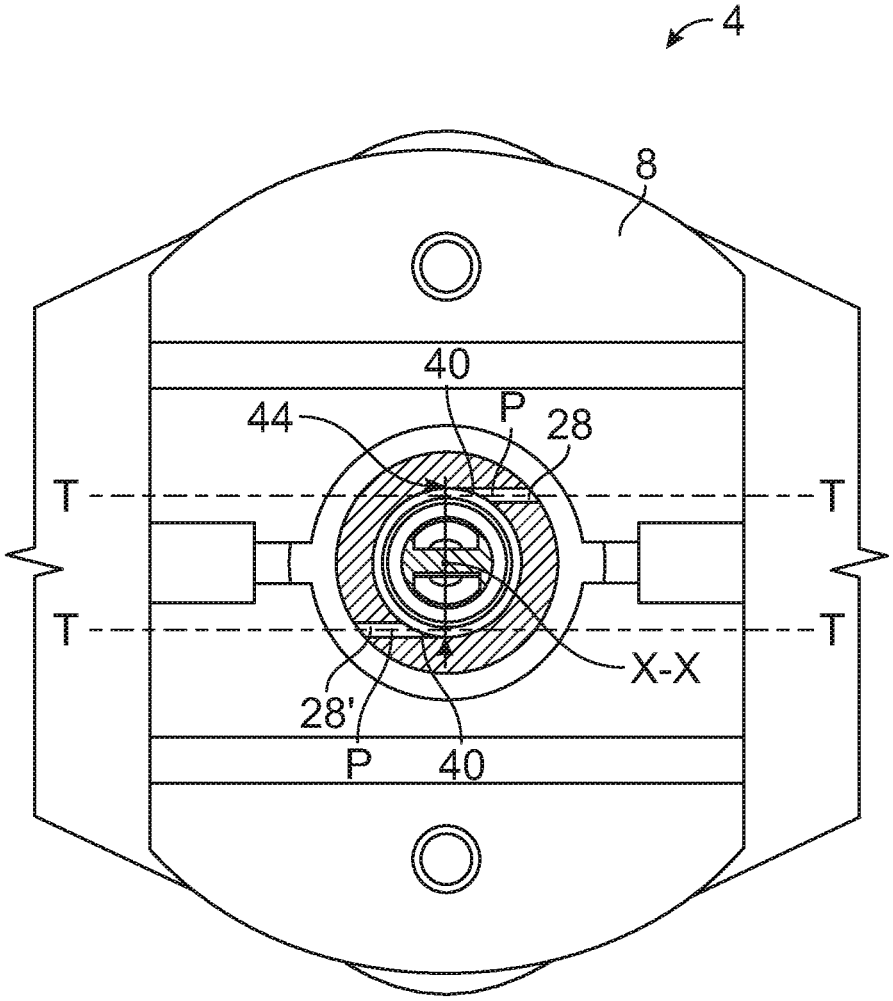
Figure 3:
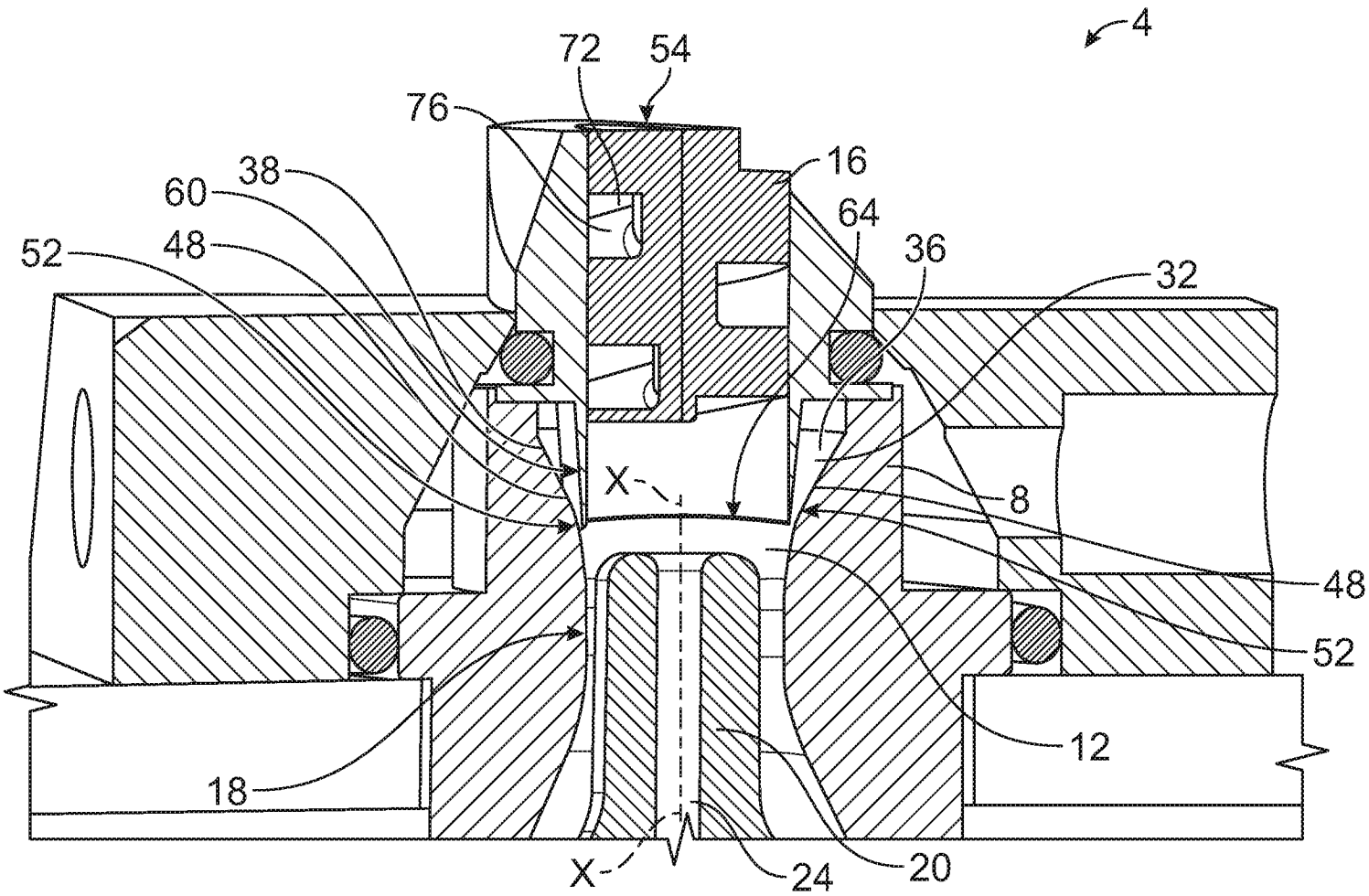
FIGS. 3-5 shows perspective cross-section views of an air-jet type spinning device according to a further embodiment of the present invention.
Figure 4:
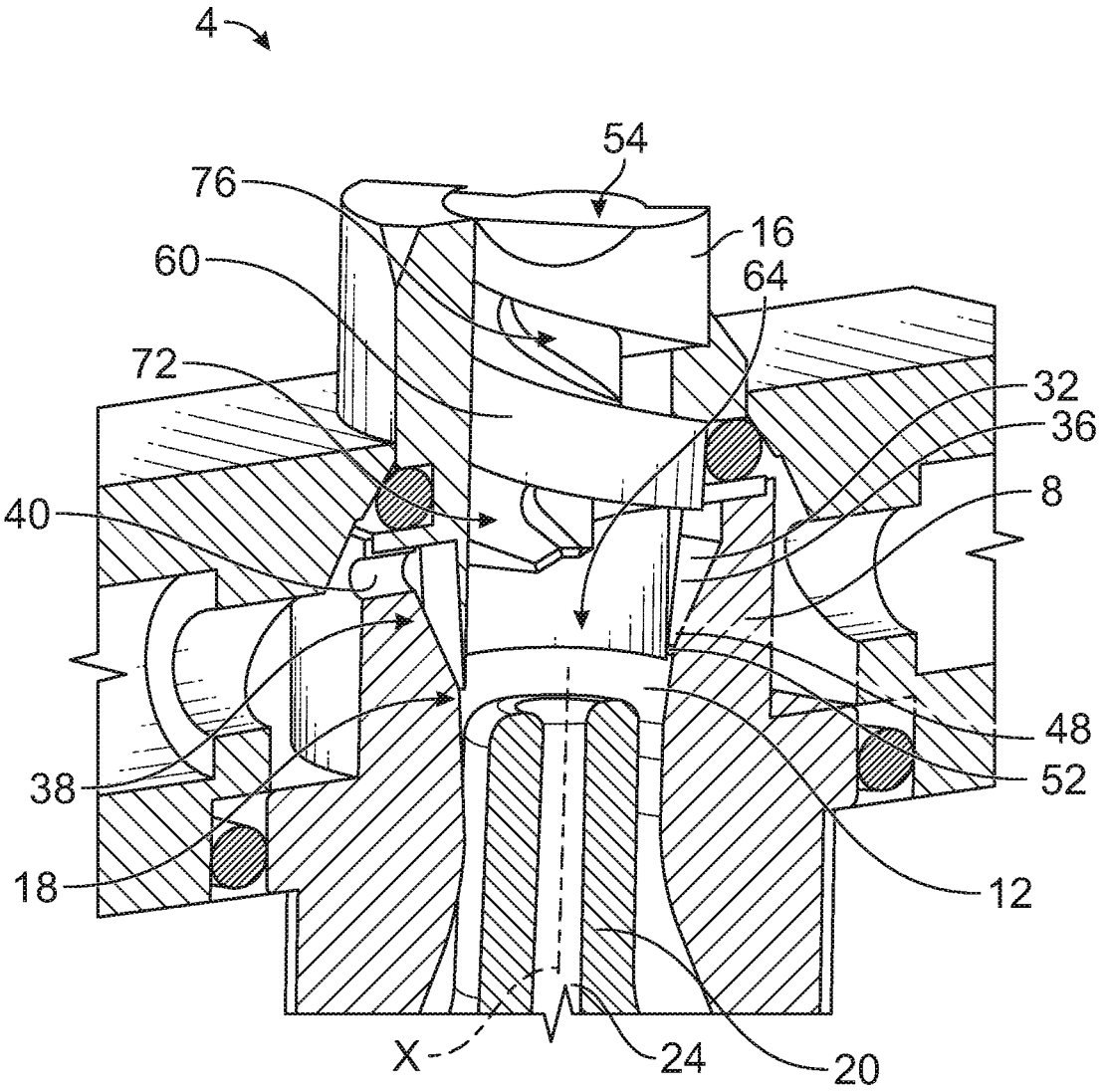
Figure 5:
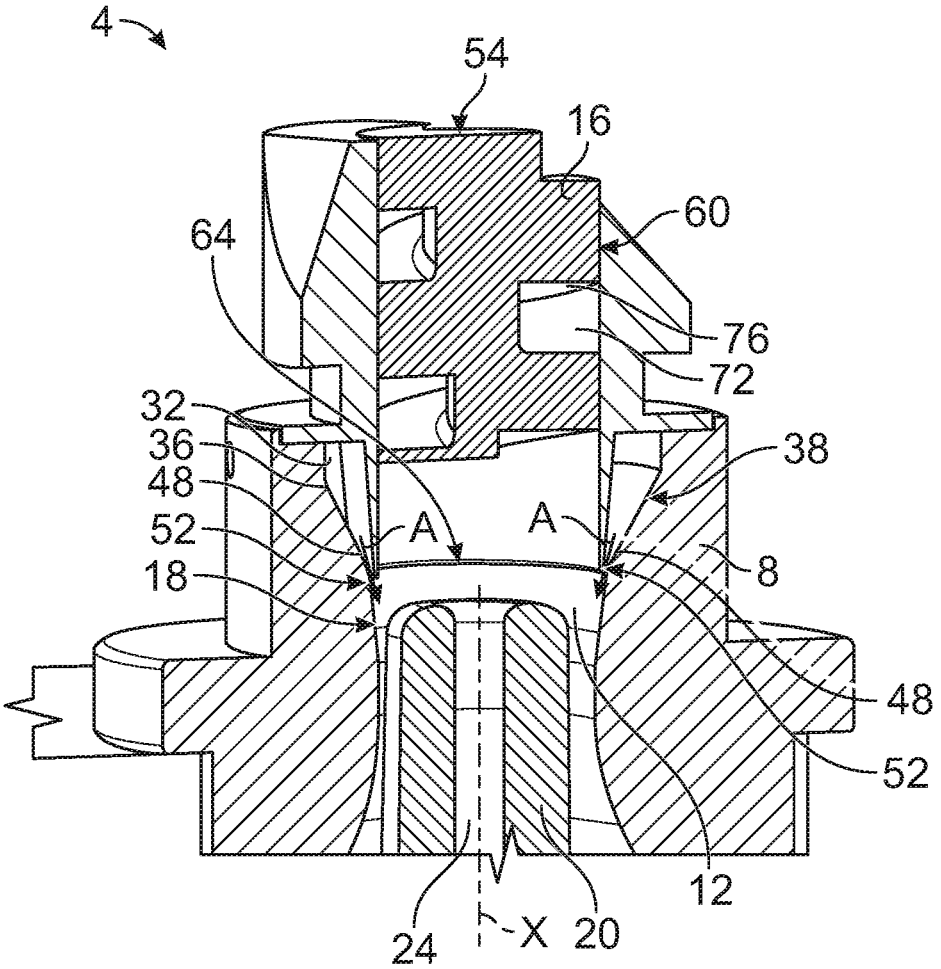

It is also possible to provide, either in combination or alternatively to the solution in FIG. 2, that the air sucked in through the suction mouth 54 be introduced into the spinning chamber 12 already with spiral motion. This effect can for example be achieved by creating a fibre feeding device 16 which delimits an air supply channel 72. The fibre feeding device 16 is bound by wall 17 of air supply channel 72. The air supply channel 72 is entirely parallel to the spinning direction (X-X) and includes at least a portion 76 partially wound in a spiral; this way the air supply channel 72 identifies a spiral portion 76 which imparts to the air sucked in by the suction mouth 54 and introduced into the spinning chamber 12, the desired spiral motion. The solution with the air supply channel 72 having a spiral portion 76 can also be applied in conjunction with the placement of the channels 26', 26" in a tangential direction T-T.

Figure 6:
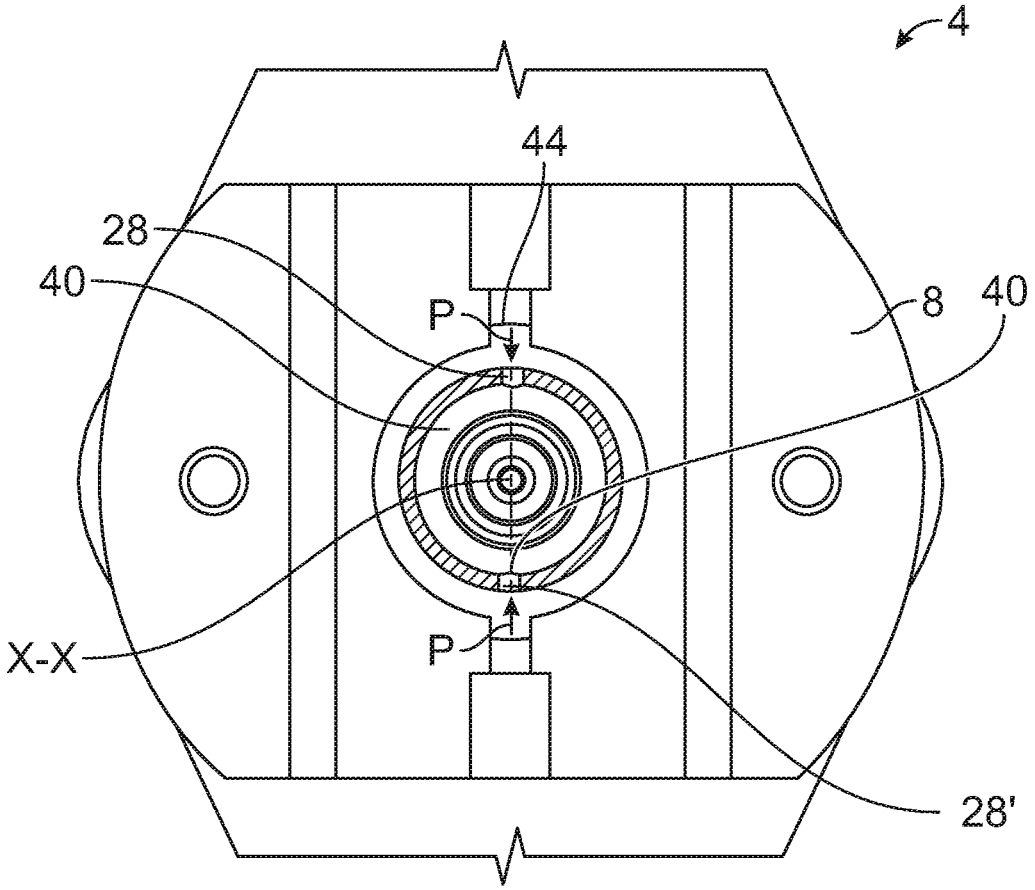
FIG. 6 is a cross-section view of the air-jet type spinning device in FIG. 3.
Figure 7:
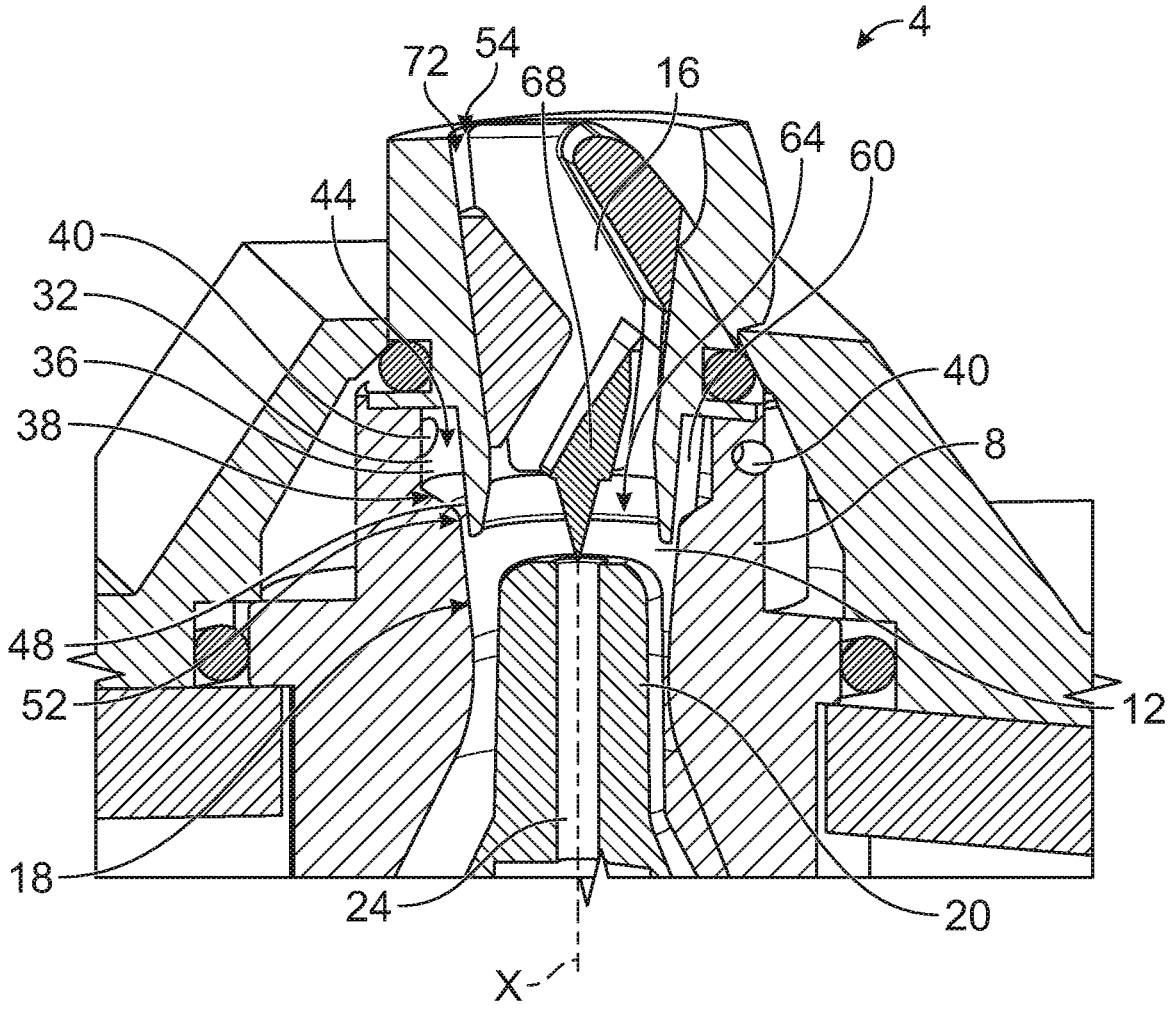
FIGS. 7-8 shows cross-section views of an air-jet type spinning device according to a further embodiment of the present invention.
Figure 8:
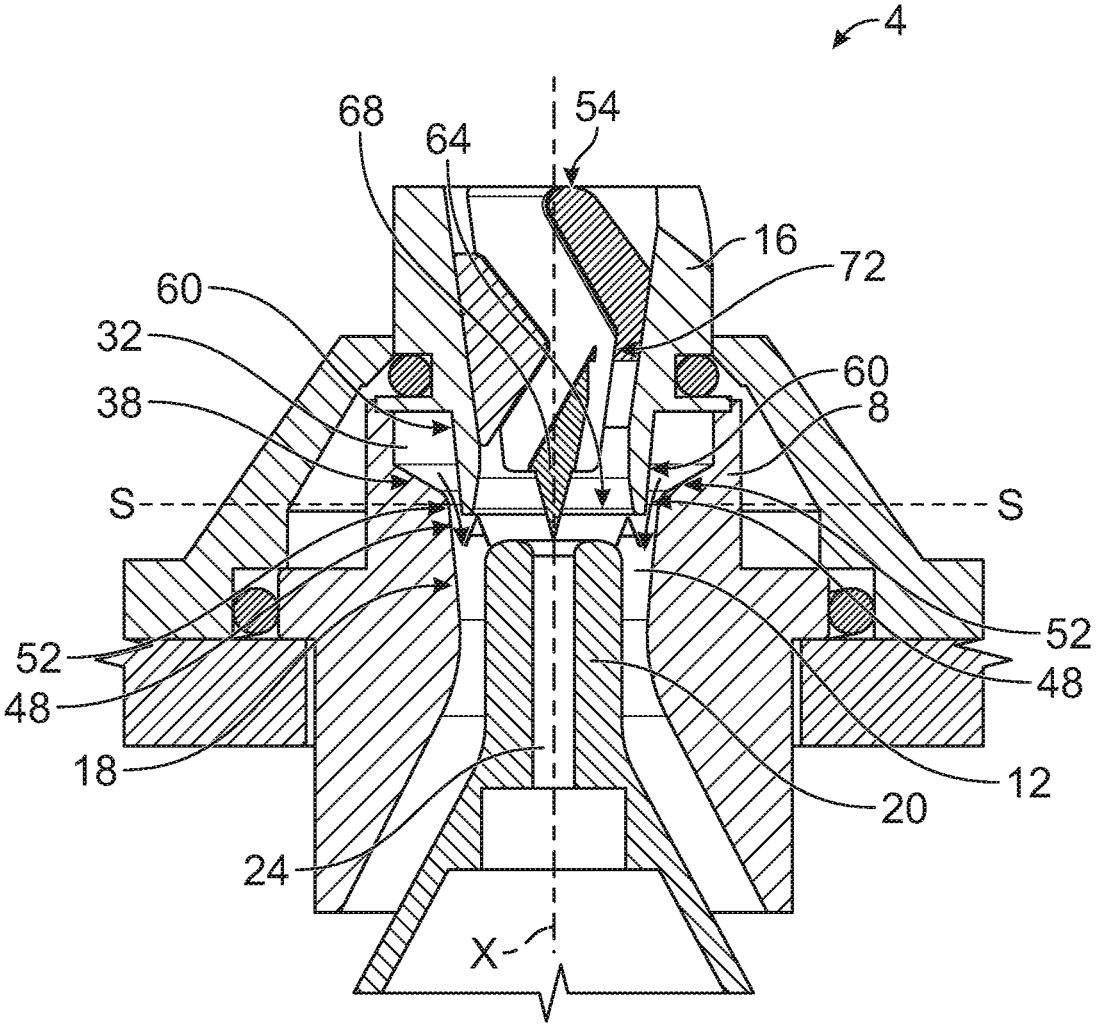

It is also possible, for example, to apply the solution with the air supply channel 72 having a spiral portion 76 to the embodiment in which the channels 28, 28' are aligned with each other towards the spinning direction (FIG. 6) without generating a spiral type air motion upstream.

The spinning chamber 12 has overall a cylindrical cross-section with respect to a cross-section plane perpendicular to said spinning direction X-X, said cross-section tapering away from the outlet mouth 48 of the expansion chamber 36.

The spinning spindle 20 has an overall cylindrical cross-section with respect to a cross-section plane perpendicular to said spinning direction X-X.

According to a possible embodiment, the spinning spindle 20 has overall a truncated cone cross-section which, with respect to said spinning direction X-X tapers towards the outlet mouth 48 of the expansion chamber 36.

The fibre feeding device 16 may also comprise a needle 68 at least partially penetrated in said spinning chamber 12, so as to form a guide for the fibres being spun.

As may be appreciated from the description, the air-jet type spinning device according to the invention makes it possible to overcome the drawbacks of the prior art.

In particular, the present invention allows a significant reduction of air consumption compared to the solutions of the prior art, in the configurations where the number of air injection channels (usually 2) is less than the conventional number (usually 4) and in those in which the injection pressure is lower.

Indeed, thanks to the air flow amplifier devices, it is possible to obtain a significantly greater flow of air drawn in from the outside towards the spinning spindle compared to the flow of compressed air injected through the relative channels. It is also possible to achieve flows comparable to those of traditional systems using lower injection pressures and taking advantage of the multiplicative effect of the flow. By doing so it is possible to obtain further reductions in the consumption of compressed air.

This way a considerable saving of compressed air is achieved and thus a significant reduction in the operating costs of the air-jet type spinning device.

In addition, thanks to the acceleration of the air towards the spinning spindle, due to the suction of air generated by the air flow amplifier, a vertical downward component, i.e. towards the spinning spindle, of the compressed air is obtained which can thus be injected from the respective channel in a substantially horizontal direction.

In addition, the present invention increases the force with which the fibres are opened and twisted to form the yarn: in fact the flow amplifier increases the vacuum obtainable for the same compressed air consumption, and therefore increases the suction force and twisting of said fibres.

Moreover, the use of a shaped wall to exploit the Coandă effect allows the air drawn in to remain substantially adhered to the outer side wall of the spinning chamber; this way, the air, although not physically guided by a channel, stays in place sufficiently distanced from the spinning channel as not to be disturbed by the dirt and fibrils which may be raised during the spinning process.

Consequently, the present invention makes it possible to achieve an increased ability to "digest" dirt and fibrils in the spinning process; this way a better yarn quality and greater consistency and repeatability of the characteristics of the yarn obtained, is ensured.

In other words, the air flow generated remains as constant and undisturbed as possible: it follows that the quality of the yarn obtained is also substantially constant during spinning.

This way, it is possible to keep the air outside the spinning spindle and the necessary vorticity is created along with the vacuum which draws the thread inside the spinning spindle.

Unlike the solutions of the prior art, it is also possible to enter with the compressed air above the point of entry of the fibres in the spinning chamber, since the airflow does not directly "disturb" the incoming fibres. This is a further advantage since it prevents interference between the fibres and the air and thus makes the spinning process more controllable, so as to obtain a yarn with features as constant and repeatable as possible.

Also compared to the solutions of the prior art, the compressed air is not injected directly into the spinning chamber, but into the expansion chamber of the flow amplifier: this way, as seen, the flow of compressed air is injected into a separate chamber from the spinning chamber, although fluidically connected to the latter, and therefore in a position where the flow is unaffected by dirt and fibrils given that the expansion chamber does not house the fibres to be spun.

In addition, thanks to the present invention it is possible to increase the overall size of the spinning chamber, so as to improve the quality of the yarn obtained.

Lastly, the increased performance obtained with the flow amplifier does not prejudice in any way the reliability of the spinning device, since the increased or amplified flow is not achieved by means of an increase in the injection pressure and given that the flow amplifier does not comprise moving parts which, over time, could wear out and break.

A person skilled in the art may make numerous modifications and variations to the air-jet type spinning devices described above so as to satisfy contingent and specific requirements while remaining within the sphere of protection of the invention as defined by the following claims.

The invention claimed is:

1. Air-jet spinning device (4) comprising:

a body (8) at least partially hollow, which delimits a spinning chamber (12)

a fibre feeding device (16), facing said spinning chamber (12) so as to feed fibres into the spinning chamber (12), a spinning spindle (20) at least partially inserted in the spinning chamber (12) and fitted with a spinning channel (24) for the suction of yarn obtained from said fibres, the spinning channel (24) defining a spinning direction (X-X), at least one channel (28) for sending a jet of compressed air to be sent inside the spinning chamber (12), an air intake channel (72) entirely parallel to the spinning direction (X-X), characterised in that the body (8) comprises a flow amplifier (32) comprising an expansion chamber (36), in fluidic connection with an outside of the body (8), through a suction mouth (54) fluidically connected to the spinning chamber (12) through said air intake channel (72), wherein the at least one channel (28) comes out in an emission point (40) inside the expansion chamber (36), to introduce compressed air at an inlet cross-section (44), measured in relation to a cross-section plane (S-S) perpendicular to said spinning direction (X-X), wherein the expansion chamber (36) comprises an outlet mouth (48) that is fluidically and directly connected to the spinning chamber (12) the expansion chamber (36) having an outlet cross-section (52) smaller than said inlet cross-section (44), said outlet cross-section (52) being measured relative to the cross-section plane (S-S) perpendicular to said spinning direction (X-X), wherein the fibre feeding device (16) is inserted inside the expansion chamber (36) up to the height of said outlet mouth (48), and said outlet mouth (48) being shaped so as to present a profile shaped to create an outlet path of air parallel to said profile by means of the Coandă effect.

2. Air-jet spinning device (4) according to claim 1, wherein the expansion chamber (36), compared to the cross-section plane (S-S) perpendicular to the spinning direction (X-X), has a circular crown cross-section.

3. Air-jet spinning device (4) according to claim 2, wherein said circular crown cross-section decreases from an upper end to a lower end towards the outlet mouth in a direction parallel to the spinning direction (X-X).

4. Air-jet spinning device (4) according to claim 2, wherein said circular crown cross-section is smaller at said outlet mouth (48) than at an inlet.

5. Air-jet spinning device (4) according to claim 2, wherein said fibre feeding device (16) is housed at least partially in the expansion chamber (36), so that said circular crown cross-section is delimited between a first outer wall (38) of the expansion chamber (36) and a second outer wall (60) of the fibre feeding device (16).

6. Air-jet spinning device (4) according to claim 1, wherein the expansion chamber (36) has a variable cross-section, measured with respect to the cross-section plane perpendicular to the spinning direction (X-X), wherein said variable cross-section decreases from the inlet cross-section (44) to the outlet cross-section (52).

7. Air-jet spinning device (4) according to claim 1, wherein said at least one channel (28) is oriented to direct the jet of compressed air inside the expansion chamber (36) according to a horizontal direction lying on a plane perpendicular to the spinning direction (X-X).

8. Air-jet spinning device (4) according to claim 1, wherein said at least one channel (28) is oriented in a direction tangential (T), in the emission point (40), to a first outer wall (38) of the expansion chamber (36).

9. Air-jet spinning device (4) according to claim 1, wherein the spinning device (4) comprises at least two channels (28, 28"), each sending a jet of compressed air into the expansion chamber (36).

10. Air-jet spinning device (4) according to claim 9, wherein said at least two channels (28, 28') are placed in positions diametrically opposite to each other with respect to an axis of symmetry parallel to the spinning direction (X-X).

11. Air-jet spinning device (4) according to claim 9, wherein said at least two channels (28, 28') which send compressed air into the expansion chamber (36) are staggered with each other with respect to the spinning direction (X-X).

12. Air-jet spinning device (4) according to claim 1, wherein the at least one channel (28) are each positioned so as to send the jet of compressed air to the emission point (40) located upstream of a feed hole (64) of the fibres to the spinning chamber (12), relative to the spinning direction (X-X).

13. Air-jet spinning device (4) according to claim 1, wherein said air intake channel (72) identifies a spiral portion (76) which gives the air drawn in by the suction mouth (54) and introduced into the spinning chamber (12) a helical motion.

14. Air-jet spinning device (4) according to claim 1, wherein the spinning chamber (12) has overall a cylindrical cross-section with respect to t cross-section plane perpendicular to said spinning direction (X-X), said cylindrical cross-section tapering away from the outlet mouth (48) of the expansion chamber.

15. Air-jet spinning device (4) according to claim 1, wherein the spinning spindle (20) has overall a cylindrical cross-section with respect to the cross-section plane perpendicular to said spinning direction (X-X).

16. Air-jet spinning device (4) according to claim 1, wherein the spinning spindle (20) has overall a truncated cone cross-section which, with respect to said spinning direction (X-X), tapers towards the outlet mouth (48) of the expansion chamber (36).

17. Air-jet spinning device (4) according to claim 1, wherein the fibre feeding device (16) comprises a needle (68), at least partially penetrated in said spinning chamber (12), so as to create a guide for the fibres being spun.

18. Air-jet spinning device (4) according to claim 1, wherein the outlet cross-section (52) has a thickness between 0.03 mm and 0.30 mm.

* * * * *